US006012320A

United States Patent [19]

Stepanenko et al.

[11] Patent Number: 6,012,320

[45] Date of Patent: Jan. 11, 2000

[54] LEAF SPRING STRAIGHTENING APPARATUS

[75] Inventors: Alexandr Vasylevich Stepanenko; Vladimir Andreevich Korol; Alexandr Pavlovich Grechenko, all of Belarus, Russian Federation

[73] Assignee: Oxford Suspension, Inc., Troy, Mich.

[21] Appl. No.: 09/007,267

[22] Filed: Jan. 14, 1998

[51] Int. Cl.[7] ..... B21D 7/02; B21D 11/02

[52] U.S. Cl. ..... 72/383; 72/298; 72/387

[58] Field of Search ..... 72/383, 386, 387, 72/388, 218, 298; 140/106, 147

[56] References Cited

U.S. PATENT DOCUMENTS

| | | | |
|---|---|---|---|
| 1,066,247 | 7/1913 | Brown, Jr. | 72/383 |
| 3,824,834 | 7/1974 | Durham | 72/387 |
| 4,716,757 | 1/1988 | McGregor | 72/387 |
| 4,798,073 | 1/1989 | Dischler | 72/218 |
| 5,001,918 | 3/1991 | Stepanenko et al. | 72/133 |
| 5,588,322 | 12/1996 | Passone | 72/387 |
| 5,836,193 | 11/1998 | Hunter et al. | 72/298 |

FOREIGN PATENT DOCUMENTS

| | | | |
|---|---|---|---|
| 63-137518 | 6/1988 | Japan | 72/383 |

*Primary Examiner*—David Jones
*Attorney, Agent, or Firm*—Dykema Gossett PLLC

[57] ABSTRACT

Disclosed is a preferred embodiment of straightening apparatus (100) featuring a pair of adjacent rotary block members (8) and (8') having channels (30) and (30') respectively disposed therein for receiving spaced-apart legs (6) and (6') of a heated leaf springs folded into a substantially flat "U" shaped configuration as block members (8) and (8') are caused to rotate in unison in opposite directions, inner walls (12) and (12') of channels (30) and (30') respectively engage and urge legs (6) and (6') away from each other whilst outer walls (10) and (10') of channels (30) and (30') respectively are operative to engage and provide support for substantially the entire length of a convex side (26) of a curved section (24) of the folded leg spring effective to prevent warpage thereof during the straightening process.

2 Claims, 3 Drawing Sheets

LEAF SPRING STRAIGHTENING APPARATUS

INTRODUCTION

This invention relates generally to apparatus for straightening a folded heated leaf spring and more particularly to apparatus for straightening a heated leaf spring that has been folded into a substantially flat "U" shaped configuration during a process for simultaneously tapering opposite ends thereof.

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

Although not limited to the particular folding or bending processes disclosed in U.S. Pat. No. 5,001,918, the disclosure of which is incorporated herein by reference, the apparatus of the present invention is particularly applicable thereto as the processes disclosed therein relate to apparatus for simultaneously tapering opposite ends of a heated leaf spring during which the heated leaf spring is straightened after having been folded or bent into a substantially flat "U" shaped configuration of which the coinventors of the present invention are amongst the coinventors of U.S. Pat. No. 5,001,918.

The straightening apparatus of the present invention provides however an improvement over the straightening apparatus disclosed in U.S. Pat. No. 5,001,918 in that it is adapted to prevent warpage from occurring at the fold or curved section of the leaf spring during the straightening process.

BRIEF SUMMARY OF THE INVENTION

Accordingly, it is an object of this invention to provide apparatus for straightening a heated folded leaf spring.

It is another object of the invention to provide apparatus for straightening a heated leaf spring folded into a substantially flat "U" shaped configuration during a process for simultaneously tapering opposite ends thereof.

It is another object of the invention to provide apparatus operative to prevent warpage from occurring at a central curved section of a heated leaf bent or folded into a substantially flat "U" shaped configuration during a process for simultaneously tapering opposite ends thereof.

DETAILED DESCRIPTION OF THE INVENTION

Figure 1:
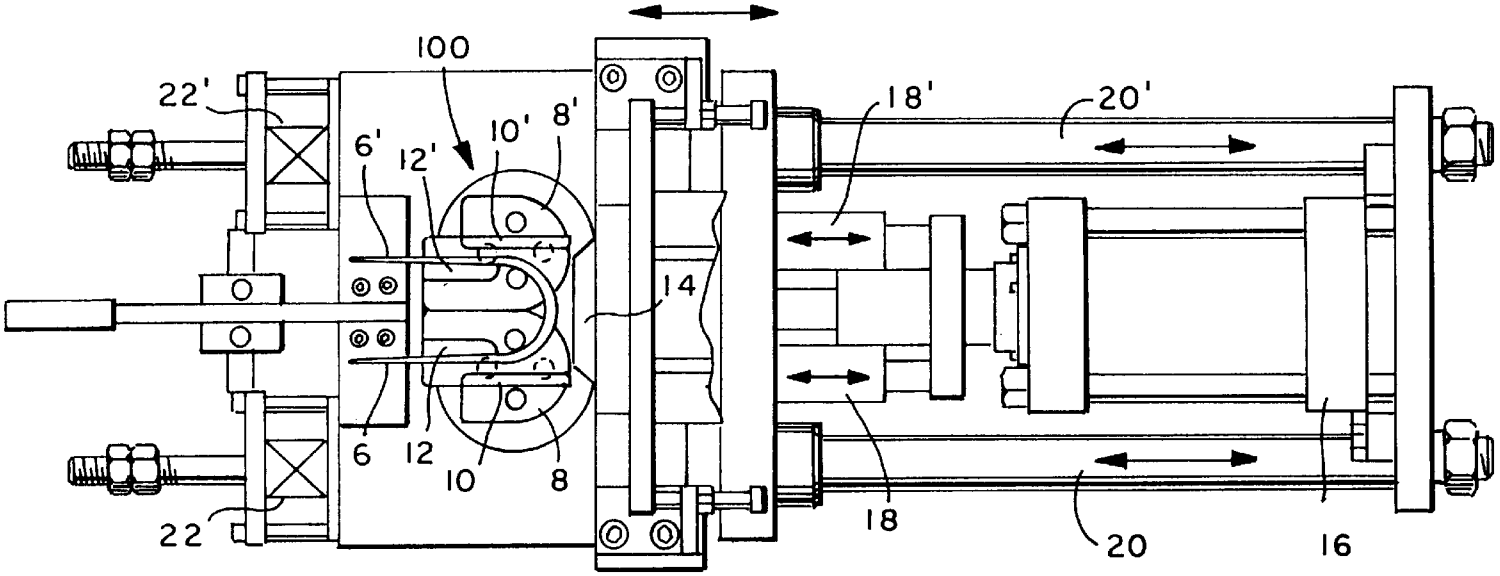
FIG. 1 is a top elevation view of a machine taken along view line 1—1 in FIG. 2 operating a preferred embodiment of apparatus for the invention referenced by numeral 100.

In FIG. 1, apparatus 100 is mounted on a machine that includes a hydraulic cylinder 16, a pair of spaced-apart shafts 20 and 20', a pair of nitrogen springs 18 and 18', and a pair of tension springs 22 and 22' whose operation is described hereafter in greater detail.

Figure 3:
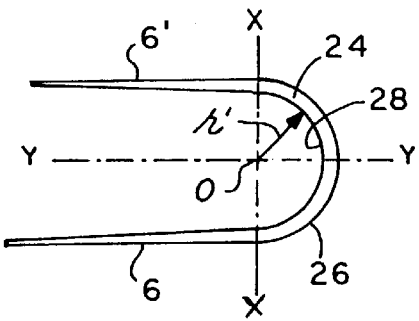
FIG. 3 is a plan elevation view of a folded leaf spring prior to being straightened by apparatus 100.

Apparatus 100 is operative to straighten a heated folded leaf spring having a pair of spaced-apart legs 6 and 6' best described with respect to FIG. 3 that is heated to a red state at a temperature of typically between about 1600F. and about 2200F.

Legs 6 and 6' taper away from opposite ends of a curved section 24 having a convex side 26 and a concave side 28.

Curved section 24 has a radius of curvature "r" whose origin "O" is located at the intersection of orthogonal axis "x" and "y" of which axis "y" bisects the space between legs 6 and 6'.

Returning to FIG. 1, cylinder 16 is operative to reciprocate shafts 20 and 20' in opposite directions as shown by the arrows.

A carriage assembly (not referenced) carries a support ram (14) that reciprocates in unison with shafts 20 and 20' and is cushioned therefrom by spaced-apart hydrogen springs 18 and 18' whose function is to keep the heated folded spring tight in a tightly held position apparatus 100.

Ram 14 is operative to engage the convex side of curved section 24 of the leaf spring to provide cushioned support there against during the straightening process.

Figure 2:
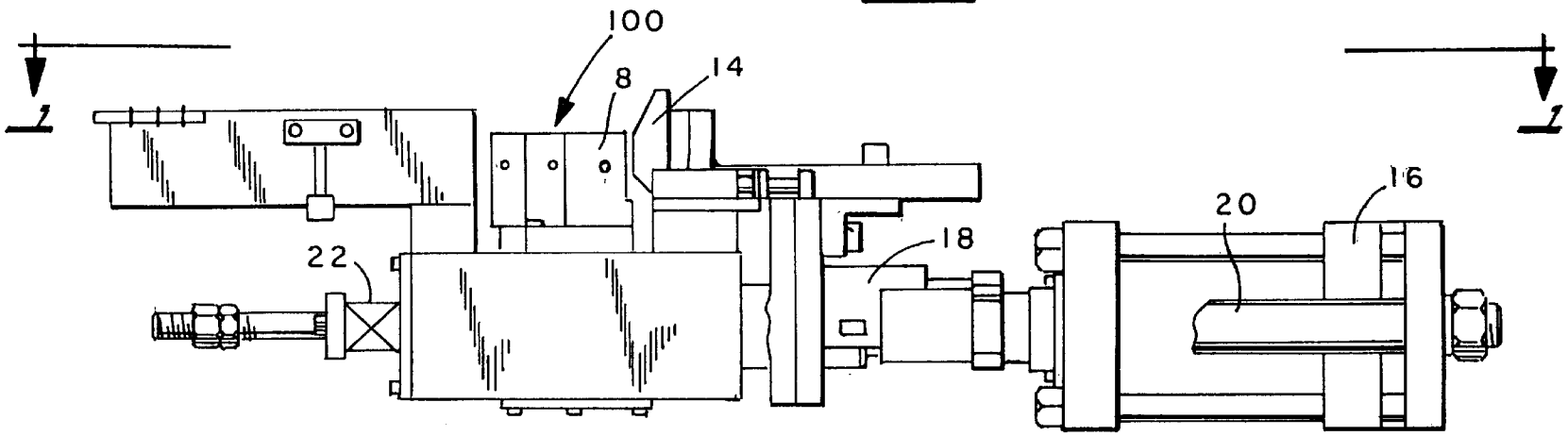
FIG. 2 is a side elevation view of the machine of FIG. 1.

A pair of tension springs 22 and 22' as shown in FIGS. 1 and 2 are operative to urge shafts 20 and 20' back towards the viewers right once the straightening process is complete and cylinder 16 enters into an exhaust stage.

Figure 4C:
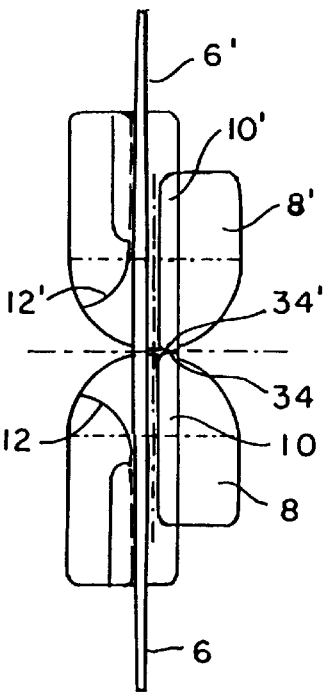
FIGS. 4A–4C are schematic diagrams of the process by which apparatus 100 straightens a folded heated leaf spring.
Figure 4B:
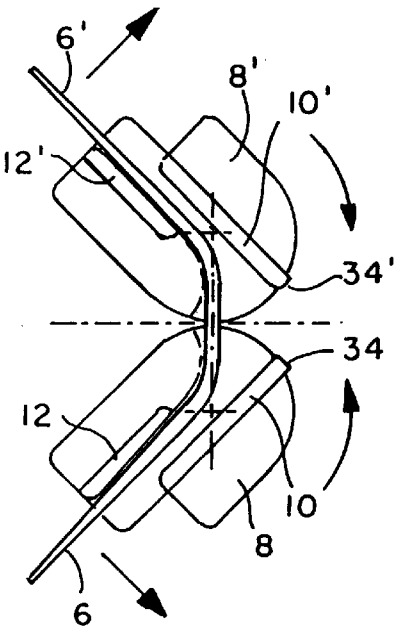
Figure 4A:
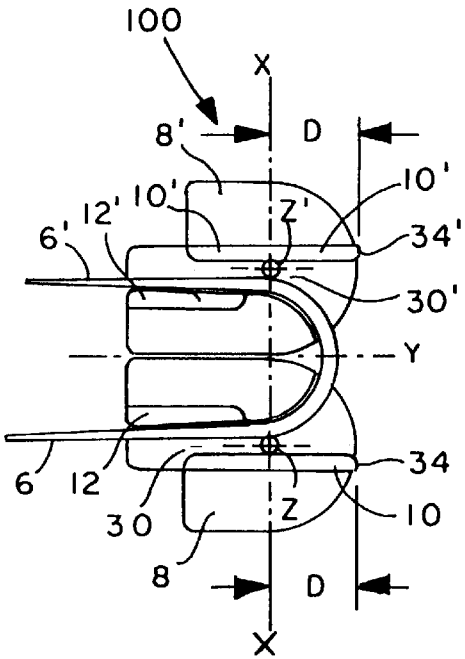

The process by which the heated folded leaf spring is straightened as best shown in FIGS. 4A–4C in which apparatus 100 is shown as having a pair of spaced-apart rotary block members 8 and 8' having respective central rotational axis "z" and "z" that are orthogonal to the plane of axis "x" and "y" and are located on axis "x" respectively outwardly adjacent the sides of legs 6 and 6' facing away from each other.

Figure 5:
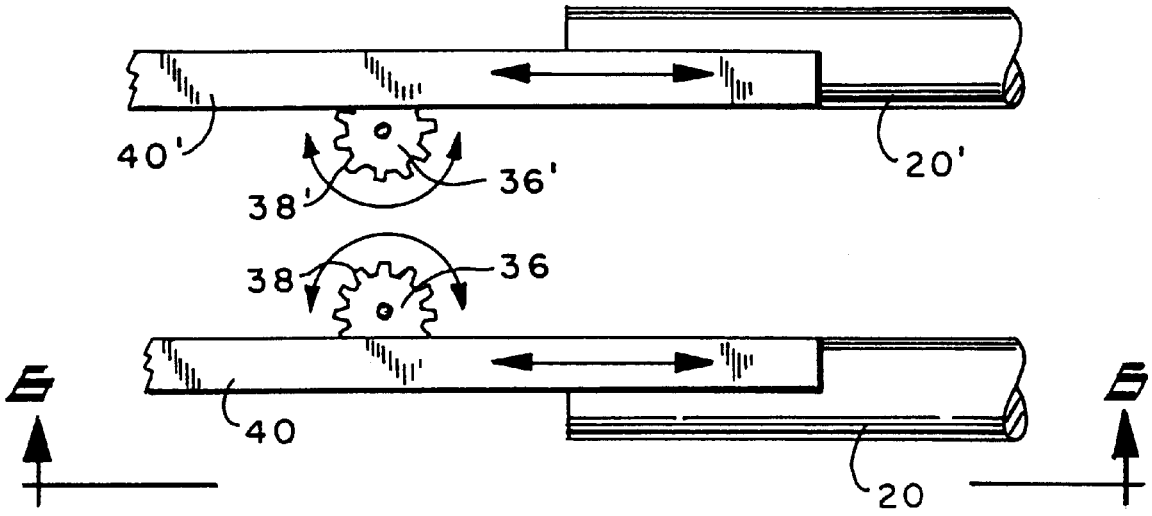
FIG. 5 is a partial top elevation view of a preferred mechanism for rotating certain components of apparatus 100 in the form of a pair of racks (40, 40') and pinions (36, 36')
Figure 6:
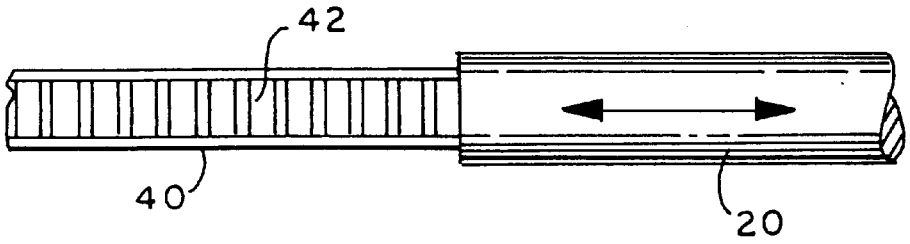
FIG. 6 is a side elevation view of the mechanism of FIG. 5 taken along view line 6—6.

Block members 8 and 8' are rotated in unison in opposite directions preferably by means of a rack and pinion arrangement such as shown in FIGS. 5 and 6 in which racks 40 and 40' are secured to shafts 20 and 20' respectively and reciprocate therewith and are respectively operative to rotate pinion gears 36 and 36' by means of having spaced windows such as referenced by numeral 42 that meshingly engage the pinion gear teeth such as 38 and 38' and cause them to rotate in opposite directions and which in turn are secured to and cause block member 8 and 8' to rotate in opposite directions in unison therewith.

Block members 8 and 8' respectively include channels 30 and 30' therein that at the start of the straightening process are positioned to respectively receive legs 6 and 6' at the folded heated leg spring thereon.

Channels 30 and 30' have respective outer walls 10 and 10' that extend beyond axis "X" for a distances "D" to free ends 34 and 34' such that the sum of both distances (2"D") is substantially the same as the length of the convex side 26 of curved section 24 of the folded heated leaf spring.

Channels 30 and 30' include inner walls 12 and 12' on the concave side of curved section 24 that extend for a prescribed distance towards axis "x" and thence turn angularly toward each other as best shown in FIGS. 4A–4C such that they release from the concave side of curved section 24 during the straightening process.

In operations, the heated folded leaf spacing is dropped vertically onto blocks 8 and 8' with its legs 6 and 6' positioned in channels 30 and 30' as previously described.

Actuation of cylinder 16 urges shafts 20 and 20' (and racks 40 and 40') toward the viewers left in FIG. 1 which in turn causes pinion gear 36 to rotate counterclockwise in unison with pinion gear 36' which is caused to rotate clockwise which in turn causes block members 8 and 8' to rotate counterclockwise and clockwise respectively as shown by the arrows in FIG. 4B.

The rotation of block members 8 and 8' urge walls 12 and 12' against legs 6 and 6' respectively and spread them angularly away from each other as shown by the arrows in FIG. 4B whilst free-ends 34 and 34' of walls 10 and 10' rotate towards each other until in close adjacent relationship with each other enabling walls 10 and 10' to provide support against the outer convex side of curved section 24 as it becomes straightened during the straightening process which is further supplemented by ram 14 which holds walls 10 and 10' against the convex side of curved section 24 when legs 6 and 6' are in substantially alignment with each other after which the straightened leaf spring is removed from apparatus 100 for cooling and other additional operations that may be desired.

We claim:

1. An apparatus for straightening a U-shaped leaf spring wherein the spring includes a curved section having a concave side and a convex side and wherein the spring has a pair of elongated legs in spaced-apart relationship with each other from the curved section of the spring and the curved section of the spring has a radius of curvature adjacent a side of the legs facing away from each other, the apparatus comprising a plurality of pivotal block members which simultaneously rotate counter to one another, each of the blocks having a channel disposed thereon adapted to receive one of the leaf spring legs therein and the channel having an outer wall facing toward the other block outer wall which extends away from the curved section of the leaf spring to a respective free end such that the combined lengths of the outer walls on both blocks is substantially the same length of the convex side of the curved section of the leaf spring; each block channel having a respective inner wall facing away from the inner wall of the opposite block and facing a concave side of the leaf spring legs and adapted to engage and provide support to the concave curved section of the leaf spring during the straightening process; and a mechanism to rotate the blocks and straighten out the leaf spring.

2. The apparatus of claim 1 wherein the rotary block members are rotated simultaneously by a rack and pinion mechanism.

* * * * *